US006820289B2

(12) United States Patent
Heil

(10) Patent No.: US 6,820,289 B2
(45) Date of Patent: Nov. 23, 2004

(54) TUB INSTALLATION SYSTEMS

(76) Inventor: Deryl Heil, 16832 330th St., Onamia, MN (US) 56359

( * ) Notice: Subject to any disclaimer, the term of this patent is extended or adjusted under 35 U.S.C. 154(b) by 223 days.

(21) Appl. No.: 10/150,133

(22) Filed: May 16, 2002

(65) Prior Publication Data

US 2003/0213060 A1 Nov. 20, 2003

(51) Int. Cl.[7] ..... A47K 3/02

(52) U.S. Cl. ..... 4/584; 4/696; 52/220.8; 285/58

(58) Field of Search ..... 4/584, 592, 593, 4/679–683, 686, 687, 695, 696; 52/220.8; 285/58, 64

(56) References Cited

U.S. PATENT DOCUMENTS

| | | | | |
|---|---|---|---|---|
| 2,121,984 A | | 6/1938 | Rieger | 285/33 |
| 2,202,147 A | | 5/1940 | Gerriets | 52/220.8 |
| 2,212,974 A | | 8/1940 | Bateman | 52/220.8 |
| 2,807,479 A | | 9/1957 | Hixon | 285/64 |
| 3,048,911 A | | 8/1962 | Almon | 52/220.8 |
| 4,261,598 A | | 4/1981 | Cornwall | 285/56 |
| 4,267,609 A | * | 5/1981 | Altman et al. | 4/584 |
| 4,313,286 A | | 2/1982 | Harbeke | 52/220 |
| 4,338,688 A | * | 7/1982 | Petty | 4/696 |
| 4,453,354 A | | 6/1984 | Harbeke | 52/220 |
| 4,490,954 A | | 1/1985 | Cresti | 52/221 |
| 4,587,082 A | | 5/1986 | Schoening | 376/291 |
| 4,619,087 A | | 10/1986 | Harbeke | 52/221 |
| 4,619,471 A | | 10/1986 | Harbeke | 285/158 |
| 4,623,170 A | | 11/1986 | Cornwall | 285/4 |
| 4,823,527 A | | 4/1989 | Harbeke | 52/221 |
| 4,882,886 A | | 11/1989 | Harbeke | 52/232 |
| 4,920,582 A | * | 5/1990 | Alker | 4/684 |
| 4,953,235 A | | 9/1990 | Corwall | 285/64 |
| 4,982,538 A | | 1/1991 | Horstketter | 52/259 |
| 5,035,097 A | | 7/1991 | Cornwall | 52/220 |
| 5,218,795 A | | 6/1993 | Horstketter | 52/125.5 |
| 5,309,688 A | | 5/1994 | Robertson | 52/220.8 |
| 5,451,081 A | | 9/1995 | Kaucnik | 285/56 |
| 5,787,672 A | | 8/1998 | Giannuzzi et al. | 52/698 |
| 5,806,829 A | | 9/1998 | Banks | 249/11 |
| 5,806,830 A | | 9/1998 | Alvarez | 251/145 |
| 6,085,362 A | | 7/2000 | Huber | 4/252.4 |
| 6,085,363 A | | 7/2000 | Huber | 4/252.4 |
| 6,101,774 A | | 8/2000 | Heil | 52/220.8 |
| 6,349,975 B1 | | 2/2002 | Heil | 285/64 |

FOREIGN PATENT DOCUMENTS

| | | |
|---|---|---|
| JP | 405033503 | 2/1993 |

* cited by examiner

*Primary Examiner*—Tuan N. Nguyen
(74) *Attorney, Agent, or Firm*—Guy McClung

(57) ABSTRACT

A method for installing a tub above a floor, in certain aspect, the floor having a plurality of spaced-apart supports beneath the floor supporting the floor, the tub to be installed on top of the floor, the tub having a drain hole for draining water from the tub, the floor having a hole to correspond in position to the drain hole of the tub, the method including securing a tub shoe beneath the tub at the drain hole, the tub shoe comprising an upright part with a fluid flow channel through the upright part in fluid communication with a fluid flow channel through a second part for draining water from the tub through the drain hole, positioning the upright part so that the second part can extend through an open portion of at least one of the plurality of spaced-apart supports supporting the floor, and connecting the second part in fluid communication with a primary drain line for receiving water from the tub.

19 Claims, 3 Drawing Sheets

Fig. 1
PRIOR ART
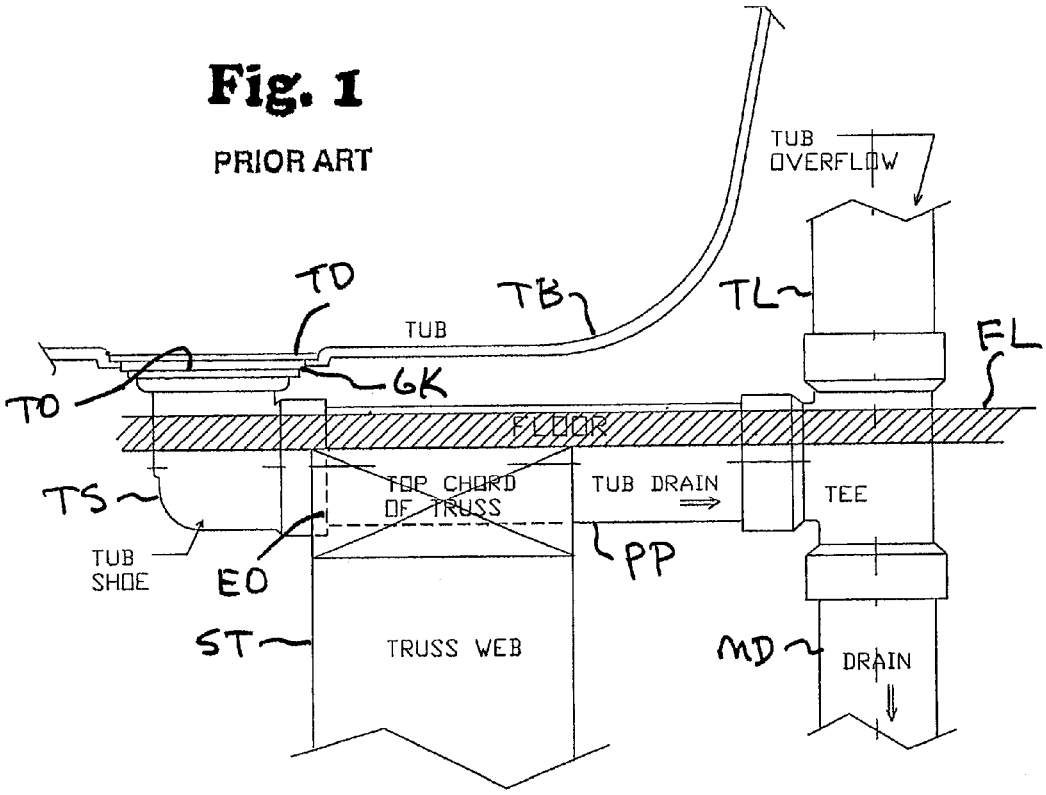
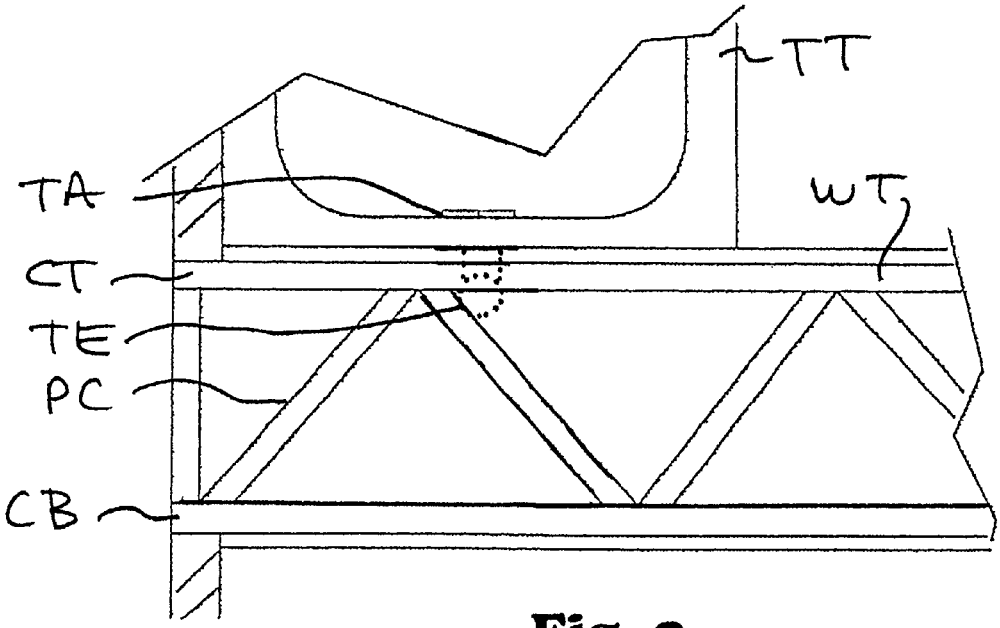
Fig. 2
PRIOR ART

Fig. 5A
Prior Art
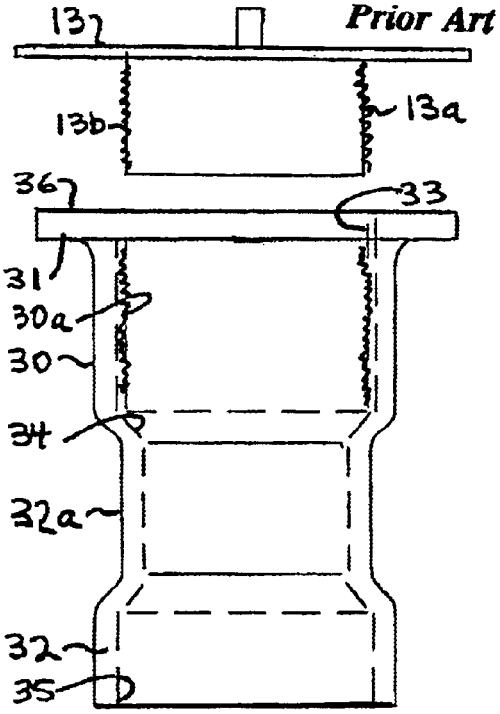
Fig. 5C
Prior Art
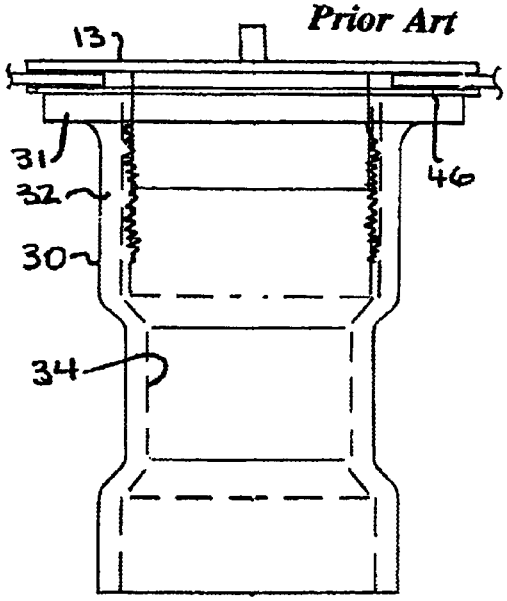
Fig. 5B
Prior Art
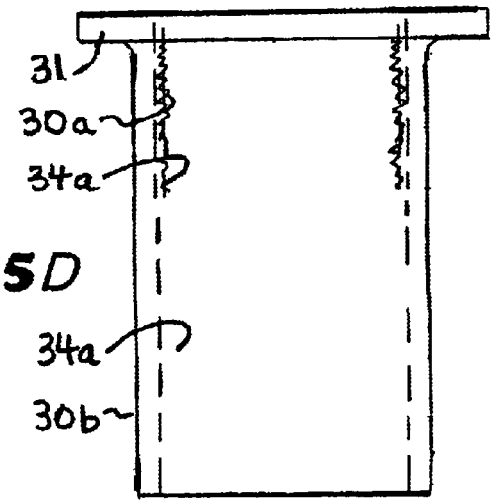
Fig. 5D

TUB INSTALLATION SYSTEMS

BACKGROUND OF THE INVENTION

1. Field of the Invention

The present invention is directed to methods for installing a tub and tub shoes useful in such methods.

2. Description of Related Art

FIG. 1 shows a typical prior art system for connecting a drain TD of a tub TB to a main drain system MD. A tub shoe TS has a top opening TO connected to the tub drain TD and an exit opening EO connected to a pipe PP that flows to the main drain system MD. A tub overflow line TL also connected to a tub vent drain (see e.g. FIG. 4, item 21) conducts water from the tub TB to the main drain system MD in the event of tub water level approaching overflow. The tub shoe TS extends through a floor FL beneath the tub and through a floor support truss ST (and/or the pipe PP) extends through the truss ST. Typically the tub drain TD has external threads that mate with internal threads at the top of the tub shoe TS. A gasket GK may be used between the tub drain and tub shoe and/or between the tub and the tub shoe.

The tub shoe TS is connected to the tub drain TD after the tub TB is installed above the floor FL. If the tub TB is to rest on a concrete slab, a depression is made in the concrete to accommodate the tub shoe TS. If the floor FL is a wood floor (without trusses like the truss ST), parts of the wood floor are cut, sawed, or notched, as needed, to allow room for the tub shoe TS. Optionally, additional floor support members are added to work around a tub shoe. Often the combined parts of the tub shoe TS and pipe PP are referred to as a "tub shoe".

Many relatively newer floors use webbed trusses WT (FIG. 2) with top and bottom members called "chords" (CT and CB, respectively, FIG. 2) and open spaces between chords called "webs". Some webs are alternating in direction of individual pieces PC (like 2×4's) in an open web design and open areas occur in an open web design as the webs alternate in position; or webs can be made of continuous material like plywood or wafer board. Preferably, the top and bottom chords present a continuous mass that is never interrupted, cut, sawed, notched, or drilled. Plywood webs can be drilled or notched without degrading a truss design.

Typically such floor trusses are spaced equally across a structure, e.g. a room or dwelling and it is not uncommon for a truss or part of a truss like a truss chord to end up in a position between a tub drain TA of a tub TT and a main drain conduit. In such a situation, a tub shoe TE, which must be connected between the tub's drain and the main drain conduit, can occupy the same space as the top chord of a truss (shown schematically in FIG. 2). If the truss is moved to accommodate the tub shoe (which often occurs), another truss is often added with increased labor demands and at increased cost.

There has long been a need recognized by the present inventor, to avoid the problems encountered when a tub shoe's space requirements conflict with the position of part of a floor truss. There has long been a need, recognized by the present inventor, to permit a tub shoe and/or its associated connections to traverse a truss without degrading truss integrity and strength and without requiring the installation of an additional truss.

SUMMARY OF THE PRESENT INVENTION

The present invention, in certain embodiments, provides a method for installing a tub above a floor that includes a plurality of spaced-apart floor trusses so that a tub shoe, according to the present invention, associated with the tub has a portion that extends through an open web area of a truss so that the truss is not degraded and so that no additional truss is needed. Such a method includes positioning a tub on a floor which includes spaced-apart floor trusses; connecting a tub drain fixture to a first top end in a top upright portion of a tub shoe according to the present invention and, optionally, connecting a second bottom end in a lower portion of the tub shoe at an angle to the upper portion of the tub shoe and connecting the lower portion of the tub shoe to a main drain system using, if necessary, a secondary piece or flow pipe between the second end of the tub shoe and a flow conduit of the main drain system. The tub shoe is of sufficient length that its angled portion aligns with an open web area of the truss; thus the secondary piece or flow pipe extends through an open area of truss web without abutting a top or bottom chord of the truss. Optionally, a hollow extender piece provides the length necessary so that a connection can be made through the truss. As needed appropriate and suitable connections and fittings are used to connect the tub shoe to a secondary piece or a flow pipe and to connect the tub shoe to the conduit of the main drain system.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

New, useful, unique, efficient, nonobvious systems and methods for installing a tub over a floor that has spaced-apart floor trusses without degrading truss integrity and without installing additional trusses or over a floor through which an appropriate opening is made through which part of a tub shoe passes;

Such a system and method in which a tub shoe according to the present invention is used which is fashioned, dimensioned, and configured so that it does not abut chords of any adjacent trusses and a lower part of the tub shoe extends through an open web area of a truss and/or a pipe connected to the tub shoe extends through an open web area of a truss and/or extender pieces—upright and/or non-upright—are used to achieve this; and Such a tub shoe that permits efficient connection of a tub drain to a main drain system when the tub is emplaced over a floor having spaced-apart trusses or a floor with appropriate open areas and methods of using such a tub shoe according to the present invention.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 1 is a side cross-section view of a prior art tub installation.

FIG. 2 is a cross-section view of a prior art tub installation.

FIG. 5A is a side view of a tub drain fixture useful with a shoe fitting according to the present invention.

FIG. 5B is a side view of a tub shoe fitting according to the present invention.

FIG. 5C is a side view of the fixture of FIG. 5A in the fitting of FIG. 5B.

FIG. 5D is a side view of a tub shoe fitting according to the present invention.

DESCRIPTION OF EMBODIMENTS PREFERRED AT THE TIME OF FILING FOR THIS PATENT

Figure 3:
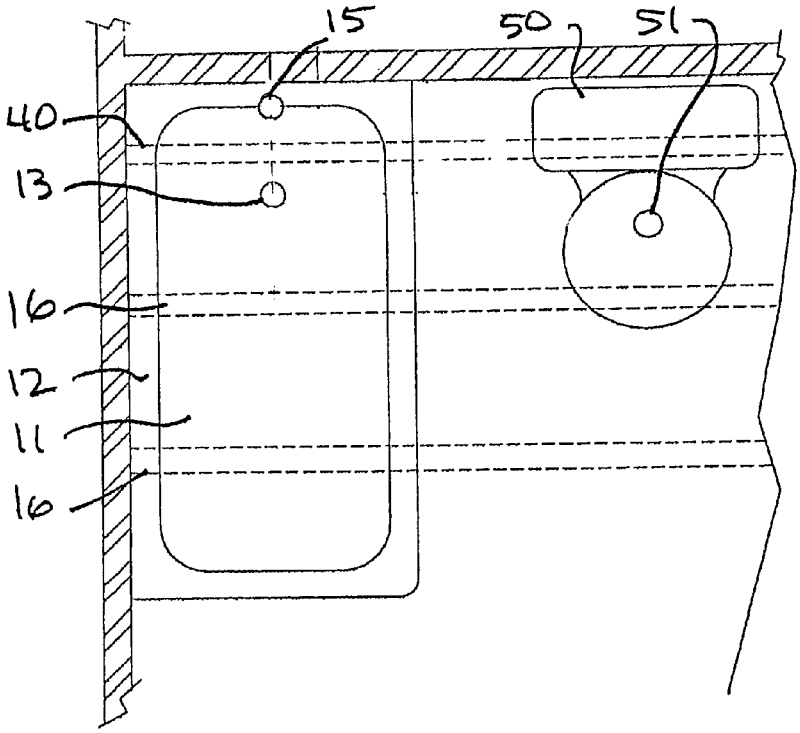
FIG. 3 is a top view of a tub installation according to the present invention.
Figure 4:
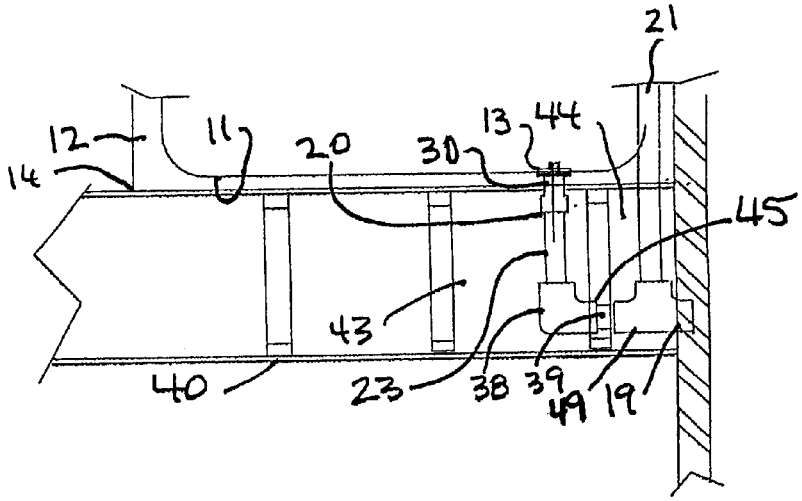
FIG. 4 is a side cross-section view of the tub installation of FIG. 3.
Figure 6:
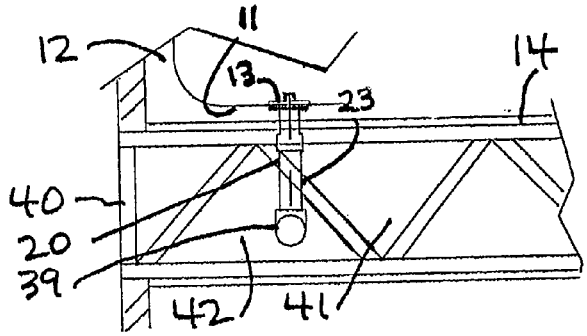
FIG. 6 is an end cross-section view of the tub installation of FIG. 3.

FIGS. 3–6 illustrate a system 10 and a method of its use for installing a tub 12 above a floor 14 that has a plurality of spaced-apart trusses 16 (including a truss 40 adjacent a tub drain 13). A tub shoe 20 according to the present invention has a top fitting 30 which is hollow with a central flow channel 34 from one end to the other and a generally cylindrical body 32 with a top flange 31, a top fluid flow opening 33, and a bottom fluid flow opening 35. A lower surface 36 of the flange 31 abuts a lower surface 11 of the tub 12. A drain fixture 13 of the tub 12 has a lower part (not shown) which threadedly engages the interior of the fitting 30 to securely position the drain fixture 13 in the tub 12. Straight threads may be used. A rubber gasket 46 may be used between the tub's bottom and the flange 31 for a water-tight seal. It is within the scope of this invention that the floor supports be solid and that the open area or areas are made theretgrhought for passage therethrough of part of a tub shoe according to the present invention. Optionally, the body 32 has a portion 32*a* with a smaller outer diameter than the rest of the body. In one aspect, the portion 32*a* has a length sufficient so that the portion of reduced diameter can accomodate a part of a floor or floor support that otherwise would impede or prevent correct tub shoe positioning and palcement. A tub shoe 20 according to the present invention has a top fitting 30 (see FIGS. 5B and 5*c*) which is hollow with a central flow channel 34 from one end to the other and a generally cylindrical body 32 with a top flange 31, a top fluid flow opening 33, and a bottom fluid flow opening 35. A top surface 36 of the flange 31 abuts a lower surface 11 of the tub 12.

A drain fixture 13 of the tub 12 has a lower part 13*a* whose threads 13*b* threadedly engage threads 30*a* on the interior of the fitting 30 to securely position the drain fixture 13 in place. Straight threads may be used.

A rubber gasket 46 may be used between the tub's bottom and the flange 31 for a water-tight seal.

FIG. 5D shows an alternative embodiment 30*b* of the fitting 30 of FIG. 5B. The fitting 30*b* has straight walls and a straight through channel 34*a*. The fitting 30, and the pipe 23, and/or the fitting 38 and/or the pipe 39 may be referred to as a tub shoe. It is within the scope of this invention that the floor supports be solid and that the open area or areas are made theretrough for passage therethrough of part of a tub shoe according to the present invention. Optionally, the body 32 has a portion 32*a* with a smaller outer diameter than the rest of the body. In one aspect, the portion 32*a* has a length sufficient so that the portion of reduced diameter can accomodate a part of a floor or floor support that otherwise would impede or prevent correct tub shoe positioning and placement.

An overflow drain 15 of the tub 12 is connected to and in fluid communication with a main drain line 19 via a pipe 21. A pipe 23 is connected between the fitting 31 and a right angle fitting 38. A pipe 39 connects the right angle fitting 38 to a tee fitting 49 whose output flows to the main drain line 19. The fitting 31 and the associated fittings and pipes between it and the main drain line 19 are sized, dimensioned, and configured so that they do not require changing of a truss 40 adjacent the tub shoe 20 and so that the truss 40 is traversed through open web areas 41–44 of the truss 40. A toilet 50 has a drain 51 also in fluid communication with the main drain line 19.

The length of the fitting 31 and/or the pipe 23 and/or the fitting 38 provide for adjustability of the level of the pipe 39 and/or of exit end 45 of the fitting 38 so that alignment with the main drain line 19 is possible and penetration of the open web area of the truss (or open area through some other floor support) is allowed. The pipe 23 may be of any desired length so that the pipe 39 can extend between and through open web areas 41. By appropriately sizing the length of the fitting 31 and/or of its upper and/or lower portion, sufficient adjustability is, in certain aspects, provided by this fitting 31 alone.

The drain fixture 13 may be a plug or a selectively adjustable drain fixture. In one particular embodiment the fitting 30 is made of PVC material and is about 3.5" long, with an outer diameter of the flange 31 of about 2.875", a flange thickness of about 0.19", and an inner diameter at its widest part of about 1.875".

It is also within the scope of the present invention to use a tub shoe system like the tub shoe system disclosed in FIGS. 3–6 in a floor without trusses like the truss 16 but with wood parts, plywood webs, or other solid parts or webs that can be drilled, cut, sawed or notched to provide desired open area(s) to accommodate the tub shoe system. Tub shoes and systems according to the present invention may be used with any floor system so that a tub shoe does not abut a part of a floor support or joist requiring alteration of the support or joist or the use of additional supports or joists (including, but not limited to, I-beam joists with plywood webs).

The present invention, therefore, in some, but not necessarily all embodiments, provides a method for installing a tub above a floor, the floor being solid but with opening(s) therethrough or having a plurality of spaced-apart supports beneath the floor supporting the floor, the tub to be installed on top of the floor, the tub having a drain hole for draining water from the tub, the floor having a hole to correspond in position to the drain hole of the tub, the method including securing a tub shoe beneath the tub at the drain hole, the tub shoe having an upright part and a second part, the upright part with a fluid flow channel through the upright part in fluid communication with a fluid flow channel through the second part for draining water from the tub through the drain hole, the upright part having a length sufficient to locate the second part at a desired level with respect to the plurality of spaced-apart supports supporting the floor, positioning the upright part so that the second part can extend through an open portion of at least one of the plurality of spaced-apart supports supporting the floor, and connecting the second part in fluid communication with a primary drain line for receiving water from the tub. Such a method may include one or some (in any possible combination) fo the folowing: wherein the upright part is substantially vertical; wherein the second part is substantially horizontal; wherein the plurality of spaced-apart floor supports includes a plurality of trusses each with open web areas and the second part extends through an open web area of at least one truss; adjusting length of the upright part to correctly position the second part; adjusting length of the second part to correctly position the tub shoe; wherein the tub shoe has an inner threaded portion and the method further including securing the tub shoe to the tub with a fixture having a portion with an outer thread, part of the fixture extending through the tub so that the portion with the outer thread threadedly engages the inner threaded portion of the tub shoe, and securing the fixture into the tub shoe to secure the tub shoe to the tub; wherein the tub shoe has an upper flange and the method further including abutting the upper flange against a lower surface of the tub; wherein the upright part includes a primary piece and a secondary piece, the primary piece having two spaced-apart ends and a primary body with a fluid flow channel therethrough from one end to the other, the secondary piece having two spaced-apart ends and a fluid flow channel therethrough from one end to the other, the secondary piece having a length such that the secondary part of the tub shoe is locatable as desired with respect to the plurality of supports supporting the floor; adjusting the length of the secondary piece to correctly position the secondary part of the tub shoe; making the open portion of the at least one of the plurality of spaced-apart supports supporting the floor through which the second part of the tub shoe extends; wherein the tub has an overflow drain and an overflow drain line extending therefrom, the method further including connecting the overflow drain line to the primary drain line; emplacing a sealing gasket between the tub and the tub shoe; wherein the upright part of the tub shoe has a generally cylindrical body with a first outer diameter and a body portion with a second outer diameter, the second outer diameter less than the first outer diameter, the method further including positioning the tub shoe so that the body portion of the generally cylindrical body accommodates part of a floor; wherein the upright part of the tub shoe has two spaced-apart ends and is generally cylindrical and has a substantially uniform outer diameter from one end to the other.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A method for installing a tub above a floor, the floor having a plurality of spaced-apart supports beneath the floor supporting the floor, the tub to be installed on top of the floor, the tub having a drain hole for draining water from the tub, the floor having a hole to correspond in position to the drain hole of the tub, the method comprising securing a tub shoe beneath the tub at the drain hole, the tub shoe comprising an upright part and a second part, the upright part with a fluid flow channel through the upright part in fluid communication with a fluid flow channel through the second part for draining water from the tub through the drain hole, the upright part having a length sufficient to locate the second part at a desired level with respect to the plurality of spaced-apart supports supporting the floor, positioning the upright part so that the second part can extend through an open portion of at least one of the plurality of spaced-apart supports supporting the floor, and connecting the second part in fluid communication with a primary drain line for receiving water from the tub.

2. The method of claim 1 wherein the upright part is substantially vertical.

3. The method of claim 1 wherein the second part is substantially horizontal.

4. The method of claim 1 wherein the plurality of spaced-apart floor supports includes a plurality of trusses each with open web areas and the second part extends through an open web area of at least one truss.

5. The method of claim 1 further comprising adjusting length of the upright part to correctly position the second part.

6. The method of claim 1 further comprising adjusting length of the second part to correctly position the tub shoe.

7. The method of claim 1 wherein the tub shoe has an inner threaded portion and the method further comprising securing the tub shoe to the tub with a fixture having a portion with an outer thread, part of the fixture extending through the tub so that the portion with the outer thread threadedly engages the inner threaded portion of the tub shoe, and securing the fixture into the tub shoe to secure the tub shoe to the tub.

8. The method of claim 1 wherein the tub shoe has an upper flange and the method further comprising abutting the upper flange against a lower surface of the tub.

9. The method of claim 1 wherein the upright part includes a primary piece and a secondary piece, the primary piece having two spaced-apart ends and a primary body with a fluid flow channel therethrough from one end to the other, the secondary piece having two spaced-apart ends and a fluid flow channel therethrough from one end to the other, the secondary piece having a length such that the secondary part of the tub shoe is locatable as desired with respect to the plurality of supports supporting the floor.

10. The method of claim 9 further comprising adjusting the length of the secondary piece to correctly position the secondary part of the tub shoe.

11. The method of claim 1 further comprising making the open portion of the at least one of the plurality of spaced-apart supports supporting the floor through which the second part of the tub shoe extends.

12. The method of claim 1 wherein the tub has an overflow drain and an overflow drain line extending therefrom, the method further comprising connecting the overflow drain line to the primary drain line.

13. The method of claim 1 further comprising emplacing a sealing gasket between the tub and the tub shoe.

14. The method of claim 1 wherein the upright part of the tub shoe has a generally cylindrical body with a first outer diameter and a body portion with a second outer diameter, the second outer diameter less than the first outer diameter, the method further comprising positioning the tub shoe so that the body portion of the generally cylindrical body accommodates part of a floor.

15. The method of claim 1 wherein the upright part of the tub shoe has two spaced-apart ends and is generally cylindrical and has a substantially uniform outer diameter from one end to the other.

16. A method for installing a tub above a floor, the floor having a plurality of spaced-apart supports beneath the floor supporting the floor, the tub to be installed on top of the floor, the tub having a drain hole for draining water from the tub, the floor having a hole to correspond in position to the drain hole of the tub, the method comprising securing a tub shoe beneath the tub at the drain hole, the tub shoe comprising an upright part and a second part, the upright part with a fluid flow channel through the upright part in fluid communication with a fluid flow channel through the second part for draining water from the tub through the drain hole, the upright part having a length sufficient to locate the second part at a desired level with respect to the plurality of spaced-apart supports supporting the floor, positioning the upright part so that the second part can extend through an open portion of at least one of the plurality of spaced-apart supports supporting the floor, connecting the second part in fluid communication with a primary drain line for receiving water from the tub, wherein the upright part is substantially vertical, wherein the second part is substantially horizontal, wherein the plurality of spaced-apart floor supports includes a plurality of trusses each with open web areas and the second part extends through an open web area of at least one truss, adjusting length of the upright part to correctly position the second part, wherein the upright part includes a primary piece and a secondary piece, the primary piece having two spaced-apart ends and a primary body with a fluid flow channel therethrough from one end to the other, the secondary piece having two spaced-apart ends and a fluid flow channel therethrough from one end to the other, the secondary piece having a length such that the secondary part of the tub shoe is locatable as desired with respect to the plurality of supports supporting the floor, and adjusting the length of the secondary piece to correctly position the secondary part of the tub shoe.

17. The method of claim 16 wherein the upright part of the tub shoe has a generally cylindrical body with a first outer diameter and a body portion with a second outer diameter, the second outer diameter less than the first outer diameter, the method further comprising positioning the tub shoe so that the body portion of the generally cylindrical body accommodates part of a floor.

18. The method of claim 16 wherein the tub shoe has an inner threaded portion and the method further comprising securing the tub shoe to the tub with a fixture having a portion with an outer thread, part of the fixture extending through the tub so that the portion with the outer thread threadedly engages the inner threaded portion of the tub shoe, and securing the fixture into the tub shoe to secure the tub shoe to the tub.

19. The method of claim 16 wherein the tub shoe has an upper flange and the method further comprising abutting the upper flange against a lower surface of the tub, and emplacing a sealing gasket between the tub and the tub shoe.

* * * * *